United States Patent [19]

Reidenbach et al.

[11] Patent Number: 4,529,625

[45] Date of Patent: Jul. 16, 1985

[54] METHOD OF MAKING A ROOFING MEMBRANE

[75] Inventors: Richard T. Reidenbach, Valparaiso, Ind.; Harry J. Rozek, Grand Haven, Mich.

[73] Assignee: Northern Fibre Products Company, Holland, Mich.

[21] Appl. No.: 578,059

[22] Filed: Feb. 8, 1984

[51] Int. Cl.[3] ..... B05D 1/12

[52] U.S. Cl. ..... 427/186; 427/196; 427/204; 427/299; 427/398.1; 427/398.2; 428/147; 428/150; 428/283; 428/286; 428/296; 428/489

[58] Field of Search ..... 428/147, 150, 283, 286, 428/296, 489; 427/186, 196, 204, 299, 398.1, 398.2

[56] References Cited

U.S. PATENT DOCUMENTS 4,342,804 8/1982 Meynard ..... 427/186

*Primary Examiner*—Marion E. McCamish

*Attorney, Agent, or Firm*—Cullen, Sloman, Cantor, Grauer, Scott and Rutherford

[57] ABSTRACT

A light-weight, roofing membrane, for application upon building roofs, formed of a fibrous sheet having one of its surfaces coated with a thin, continuous layer of asphalt bonded only to the outermost portion of the surface of the sheet, with the voids and crevices between the fibers, within the body of the sheet, being substantially free of asphalt. The membrane is made by chilling one surface of a fibrous sheet while flowing heated asphalt upon the opposite surface of the sheet and rapidly cooling the deposited asphalt so that it solidifies and bonds to the surface portion only of the sheet fibers before it flows into the body of the sheet. A layer of fine particles of silica-like sand is applied to the exposed surface of the asphalt and bonded thereto by the asphalt.

7 Claims, 3 Drawing Figures

METHOD OF MAKING A ROOFING MEMBRANE

BACKGROUND OF INVENTION

This invention relates to a roofing membrane or what is commonly referred to as a roofing felt. Commonly used roofing felt is made in sheets which are about three feet wide and are rolled into rolls of about 80 pounds weight. The material is used over the furred roof surface and beneath the tile or shingles which are applied upon a roof.

The length of sheet is essentially determined by the amount of material which makes up an 80 lb. weight. That is, 80 pounds appears to be an historically, arbitrarily, selected weight for a roll of roofing material which can be handled by roofers in lifting the rolls upon the roofs of the buildings and working with them.

Typical roofing felt has an expected life of about twenty years. That is, a roof on a residential dwelling is generally considered to have a twenty year life, approximately, after which it must be replaced or repaired substantially.

The invention herein relates to an improved roofing felt or roofing membrane which is much lighter in weight, per square foot, than conventional roofing felt so that an 80 pound roll contains considerably more sheet material than common roofing felt. In addition, the material is anticipated to have a life expectancy which is considerably greater than that of common roofing felt.

SUMMARY OF INVENTION

The invention herein relates to a roofing membrane which is formed of a fibrous cloth-like sheet material, preferably non-woven synthetic fibrous material, which is coated with a thin layer asphalt that is bonded only to the surface of the cloth-like sheet. The sheet body is essentially free of asphalt within the voids and crevices between the fibers. Fine grains or particles of silica-like sand are applied to the exposed surface of the asphalt and bonded thereto by the asphalt. That is, by applying the sand to the asphalt when it is warm, the sand mechanically bonds to the asphalt surface.

The invention contemplates manufacturing the roofing membrane herein by means of chilling one surface of the fibrous sheet, as by pulling it across a cool bed or surface, while flowing and spreading molten asphalt upon the opposite surface of the sheet. The molten asphalt is rapidly chilled due to the cooled bed, so that it solidifies before the asphalt flows into the voids and crevices between the fibers within the body of the sheet. Instead, the asphalt bonds to and flows around the uppermost extremities or uppermost portion of the surface of the fibrous sheet. The sand may be applied to the asphalt while the asphalt is still warm.

The composite roofing membrane is lightweight as compared with prior roofing sheets or membranes. Thus, because the weight per unit area is so much less than conventional roofing material, the sheet may be formed in conventional three foot wide, 80 pound rolls. However, the lengths of such rolls will be considerably greater than conventional rolls. Thus, if made into conventional 80 pound weight rolls, much fewer rolls are required for a typical roofing job. This is translated into considerably less time, labor and handling for the roofers. Alternatively, the rolls can be made of a shorter length, but weigh less than 80 pounds per roll.

Significantly, roofing membranes formed in the manner disclosed in this application have an anticipated life of considerably greater than twenty years. They are expected to last almost indefinitely, that is, they are expected to last about the same as other durable materials used within the dwelling construction. Hence, it is anticipated that constructing or reconstructing a roof with the composite roofing membrane herein will have a considerable long term effect upon the cost of construction and maintenance of a building.

Hence, it is a major object of this invention to provide a light-weight per unit area, longer lasting, composite roofing membrane or sheet formed of a fibrous sheet base material having a thin, continuous asphalt coating upon its surface only, which can either be formed in rolls of conventional weight, but greater material content, or alternatively in rolls of lighter weight and standard length.

These and other objects and advantages of this invention will become apparent upon reading the following description, of which the attached drawings form a part.

DETAILED DESCRIPTION

Figure 1:
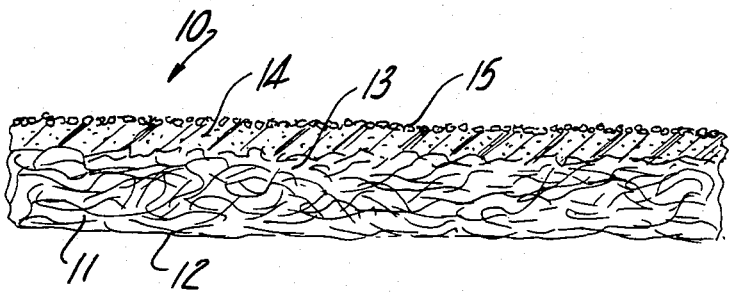
FIG. 1 is a schematic, cross-sectional view of the roofing membrane herein.
Figure 2:
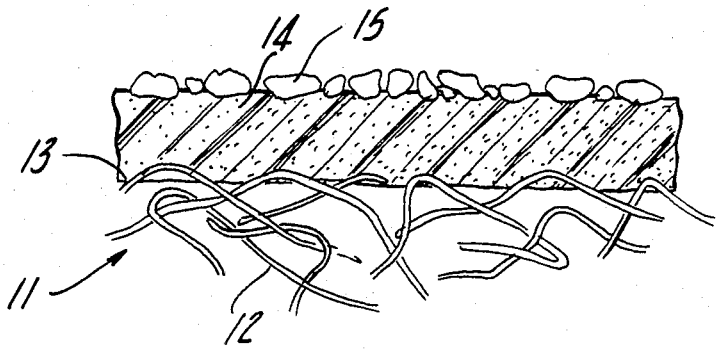
FIG. 2 is a large, fragmentary, cross-sectional view of the membrane, showing the interconnection between the fibrous sheet material and the asphalt layer.
Figure 3:
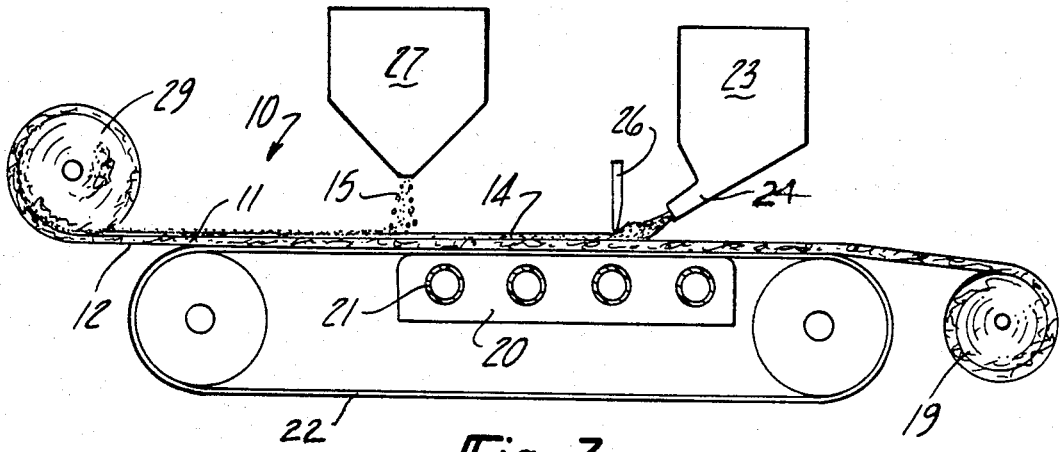
FIG. 3 is a schematic, elevational view, showing the procedure and equipment for manufacturing the roofing membrane.

Referring to FIGS. 1–3, the roofing membrane 10 is formed from a fibrous sheet material 11 having a lower surface 12 and an upper surface 13. A thin layer of asphalt 14 is applied upon the upper surface 13.

The fibrous material is preferably made of non-woven, synthetic plastic material. A suitable material for this purpose is a non-woven, spun bonded, polypropylene of about 2½ to 3½ ounces per square yard weight, having a melt temperature of at least about 220° F. Such material is manufactured by DuPont and is referred to by DuPont's trade name of "Typar".

The asphalt is preferably of a material which is commonly known as "steep" asphalt, having a melt temperature which is considerably lower than that of the fibrous material. One commercially available asphalt found to be suitable is known as ASTMD-312, Type 3. The DuPont Typar found to be suitable is identified under the designation of Style 3301.

A thin coating or layer of grains or particles of sand 15 is applied upon the exposed surface of the asphalt. A suitable sand for this purpose is identified as F140 produced by the Ottawa Silica Company of Ottawa, Ill. and specified as 90% through a 100 mesh, fine silica sand. This sand which is dusted or lightly coated over the surface acts as a parting sand which will not be absorbed into the asphalt.

The composite roofing membrane, including the asphalt layer and the sand coating, useful for commercial purposes, weighs roughly 8–9 ounces per square yard. Thus, it can be seen that this is considerably lighter than conventional roofing felt or roofing membrane.

To manufacture the roofing membrane, a roll 19 of fibrous sheet material is spread out and passed over a cold plate 20 having internal, or externally arranged, cooling tubes 21 through which a cooling fluid, such as cold water, can be passed. The plate can be either flat or can be in the shape of a roll or curved surface. The fibrous sheet may be carried upon an endless conveyor belt 22.

As the fibrous material moves over the cold surface of the plate, it is chilled. A heated tank or container 23 holding flowable, molten asphalt, feeds through a nozzle 24, a stream of molten asphalt upon the upper surface 13 of the sheet. A blade 26 or a suitable roller may be used to spread out the stream of asphalt into a substantially uniform thick layer.

Because of the chilling effect of the cold plate upon the sheet, the asphalt is rapidly chilled or solidified as it makes contact with the upper surface of the sheet. Thus, the asphalt flows around and solidifies, for bonding purposes, to the uppermost portions of the fibers at the surface. The solidification is sufficiently rapid to prevent the asphalt from flowing into the body of the sheet, that is to fill the voids and crevices between the fibers. Consequently, a thin layer, such as on the order of roughly 0.001 inch may be formed only upon the surface of the sheet.

Preferably, before the asphalt completely solidifies, grains of sand are dusted or deposited upon the exposed surface of the asphalt through a hopper 27 which contains the sand. Hence, the asphalt is sufficiently warm so as to adhere or bond to the sand.

The completed membrane may then be formed into a roll 29 of sufficient length to make up an 80 pound weight, as is conventional, or alternatively, into a length of a lesser amount of weight, as desired.

In operation, the roofer unrolls the roll 29 to spread out the sheet upon the roof surface, such as upon the furred roof construction. The membrane may be secured to the roof base by means of conventional nailing or stapling. Thereafter, the usual tiles and the like roof surfaces can be applied upon the membrane in the conventional manner.

Because of the light weight of the membrane, per square yard, as contrasted with conventional roofing material, the overall weight of the roof can be significantly reduced. In addition, the roofing material can be handled by the roofers with considerably less difficulty than conventional material so as to reduce the time and effort required for application. Lastly, the anticipated life of this material is considerably greater than the normal twenty year life expectancy of common roofing membranes.

Having fully described an operative embodiment of this invention, we now claim:

1. A method for making a roofing membrane comprising essentially the steps of:

providing a sheet of non-woven, synthetic fiber material;

cooling one surface of the sheet;

applying a thin layer of molten asphalt, whose melt temperature is lower than that of the cooled sheet, upon the opposite surface of the sheet, for rapidly cooling the asphalt upon its contact with the sheet;

and bonding the cooling asphalt to the outermost portion of the surface of the fibrous material sheet, and sufficiently solidifying the asphalt rapidly enough to prevent the asphalt from filling the voids and crevices between the fibers within the body of the sheet;

thereby producing a uniform, thin, moisture impervious asphalt layer upon the surface only of the fibrous sheet.

2. A method as defined in claim 1, and applying a layer of fine grain sand of a silica-like material upon the exposed face of the asphalt while the asphalt is warm for mechanically bonding the sand to the asphalt.

3. A method as defined in claim 2, and including a coating of fine grains of silica-like sand, as for example being roughly of a size of 90% passage through a 100 mesh screen.

4. A method as defined in claim 1, and said sheet being formed of a non-woven, spun bonded, polyproplene material of between about $2\frac{1}{2}$ to $3\frac{1}{2}$ ounces per square yard, and having a melting temperature which is considerably higher than that of the asphalt.

5. A method as defined in claim 1, and said asphalt being of a steep-type asphalt having a melting temperature in the range of between about 185° to 200° F. approximately.

6. A method as defined in claim 1, and said asphalt layer being considerably thinner than the sheet, such as roughly about 0.001 inches in thickness.

7. A method as defined in claim 1, and wherein such sheet is formed of a non-woven, spun bonded, polypropylene material of between about $2\frac{1}{2}$ to $3\frac{1}{2}$ ounces per square yard, and having a melting temperature that is considerably higher than that of the asphalt, such as in the range of at least about 220° F.;

and said asphalt being of a steep-type asphalt having a melting temperature in the range of between about 185° to 200° F., approximately.

* * * * *